US007758395B2

(12) United States Patent
Kim et al.

(10) Patent No.: US 7,758,395 B2
(45) Date of Patent: Jul. 20, 2010

(54) LOWER PLATE OF PDP AND METHOD FOR MANUFACTURING THE SAME

(75) Inventors: Yong Ho Kim, Chungcheongbuk-do (KR); In Cheol Kim, Chungcheongbuk-do (KR)

(73) Assignee: LG Electronics Inc., Seoul (KR)

( * ) Notice: Subject to any disclaimer, the term of this patent is extended or adjusted under 35 U.S.C. 154(b) by 951 days.

(21) Appl. No.: 11/509,643

(22) Filed: Aug. 25, 2006

(65) Prior Publication Data

US 2007/0103071 A1 May 10, 2007

(30) Foreign Application Priority Data

Nov. 7, 2005 (KR) ..... 10-2005-0105856

(51) Int. Cl.
*H01J 17/49* (2006.01)
*H01J 9/00* (2006.01)

(52) U.S. Cl. ..... 445/24; 313/587

(58) Field of Classification Search ..... 313/582–587; 445/24–25

See application file for complete search history.

(56) References Cited

U.S. PATENT DOCUMENTS 5,972,528 A * 10/1999 Kim ..... 428/697
6,184,621 B1 * 2/2001 Horiuchi et al. ..... 313/586

FOREIGN PATENT DOCUMENTS

| | | | |
|---|---|---|---|
| CN | 1389892 | A | 1/2003 |
| EP | 1003199 | A2 | 5/2000 |
| JP | 2000-149772 | A | 5/2000 |
| KR | 2004049706 | A * | 6/2004 |
| WO | WO 2004/053915 | A1 | 6/2004 |

* cited by examiner

*Primary Examiner*—Nimeshkumar D. Patel
*Assistant Examiner*—Anne M Hines
(74) *Attorney, Agent, or Firm*—Birch, Stewart, Kolasch & Birch LLP

(57) ABSTRACT

A method of manufacturing a plasma display panel, which includes forming a lower dielectric layer on a lower substrate, disposing a mesh over the substrate on which the lower dielectric layer is formed, dispersing a glass powder through the mesh, forming a barrier rib-forming layer by applying a certain amount of heat and pressure to the dispersed glass powder, and forming barrier ribs by selectively removing the barrier rib-forming layer.

10 Claims, 4 Drawing Sheets

LOWER PLATE OF PDP AND METHOD FOR MANUFACTURING THE SAME

This application claims priority to Korean Patent Application No. 10-2005-0105856 filed on Nov. 7, 2005, in Korea, the entire contents of which is hereby incorporated by reference in its entirety.

BACKGROUND OF THE INVENTION

1. Field of the Invention

The present invention relates to a plasma display panel and method for manufacturing the same, and more particularly to a method of forming a barrier rib-forming layer and lower dielectric layer using a glass powder.

2. Description of the Related Art

Plasma display panels (PDPs) are flat panel display devices that display images or information using a plasma discharge. PDPs generally are divided into DC-types and AC-types according to the panel structure and driving method. In addition, the PDPs generate visible rays obtained from the energy difference when an ultraviolet ray generated due to the plasma discharge of a gas (such as He, Xe, etc.) provided in each cell excites a phosphor lining in the cell, which emits a visible photon when returning to the ground state.

Further, PDPs have advantages such as an easy manufacturing process, simple structure, high brightness, high luminous efficiency, memory capacity, and a wide viewing angle of over 160°. PDPs are also used in 40+ inch wide screens. The PDP generally includes an upper substrate and an oppositely disposed lower substrate, barrier ribs, and cells defined by the two substrates and barrier ribs.

In addition, transparent electrodes are disposed on the upper substrate, and bus electrodes are disposed on the transparent electrodes to reduce the resistance of the transparent electrodes. Address electrodes, which are also called data electrodes, are formed on the lower substrate.

Also, the cells divided by the barrier ribs are lined with phosphors. An upper dielectric layer is disposed on the upper substrate to cover the transparent electrodes and the bus electrodes, and a lower dielectric layer is disposed on the lower substrate as to cover the address electrodes. In addition, a protection layer including magnesium oxide, for example, is disposed on the upper dielectric layer.

The barrier ribs are present to maintain a discharge space between the upper and lower substrates, and also to prevent electrical, optical cross-talks between the adjacent cells. The formation of the barrier ribs is an important step in manufacturing quality PDPs. This is especially true as the size of panels grows larger and larger.

In general, the barrier ribs are formed using a Sand Blasting method, Screen Printing method, or Photo Etching method. In the Sand Blasting method, the address electrodes and the dielectric layer are first formed on the lower substrate, and then a glass paste is applied thereon and is used to form the barrier ribs, followed by a sintering process. Then, a stripe type mask pattern is disposed thereon, and fine sand particles are sprayed with high speed through the mask pattern, thereby forming the barrier ribs. However, the equipment used in the Sand Blasting method is expensive. The Sand Blasting method is also relatively complex and tends to cause cracks during the sintering step, because a considerable physical impact is applied to the lower substrate.

In the Screen Printing method, the address electrodes and the dielectric layer are formed on the lower substrate, followed by a stripe type screen being disposed thereon. Subsequently, printing is performed repeatedly with a glass paste used in forming the barrier ribs until the barrier ribs with a desired thickness are obtained, and sintering is performed thereafter. However, the Screen Printing method requires the screen-printing step be repeated to obtain the barrier ribs with a desired thickness, because one screen-printing step is insufficient. This repetitive process renders the process complex.

In the Photo-etching method, the address electrodes and the dielectric layer are first formed on the lower substrate, and then a paste used to form the barrier ribs is applied thereto. Then, a stripe type of mask pattern is positioned, and then the barrier ribs are shaped by etching an exposed portion through openings of the mask with an etching agent, followed by sintering. However, in the Photo-etching method, the process is delayed because the paste has to be applied several times to shape a desired thickness of barrier ribs. Also, it is difficult to obtain the barrier ribs having a sufficient structurally and mechanically stable shape to retain a discharging space because the side portions of the barrier ribs are over-etched.

Therefore, the related art method for forming the barrier ribs is complex, time-consuming and expensive. Further, it is difficult to form barrier ribs with a desired shape and mechanical strength.

SUMMARY OF THE INVENTION

Accordingly, one object of the present invention is to address the above-noted and other objects.

Another object of the present invention is to provide a lower plate of a PDP having barrier ribs and lower dielectric layers formed with a glass powder.

To achieve these and other objects, as embodied and broadly described, the present invention provides in one aspect a method of manufacturing a plasma display panel including forming a lower dielectric layer on a lower substrate, disposing a mesh over the substrate on which the lower dielectric layer is formed, dispersing a glass powder through the mesh, forming a barrier rib-forming layer by applying a certain amount of heat and pressure to the dispersed glass powder, and forming barrier ribs by selectively removing the barrier rib-forming layer.

In another aspect, the present invention provides a plasma display panel including a lower dielectric layer disposed on a lower substrate, sintered-glass-powder barrier ribs disposed on the lower dielectric layer, and an upper substrate spaced above the lower substrate via the sintered-glass-powder barrier ribs so as to form the plasma display panel.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

These and other features, aspects and advantages of the present invention will become better understood with regard to the following description, appended claims, and accompanying drawings where:

DETAILED DESCRIPTION OF THE INVENTION

Reference will now be made in detail to the embodiments of the present invention, examples of which are illustrated in the accompanying drawings.

Figure 1:
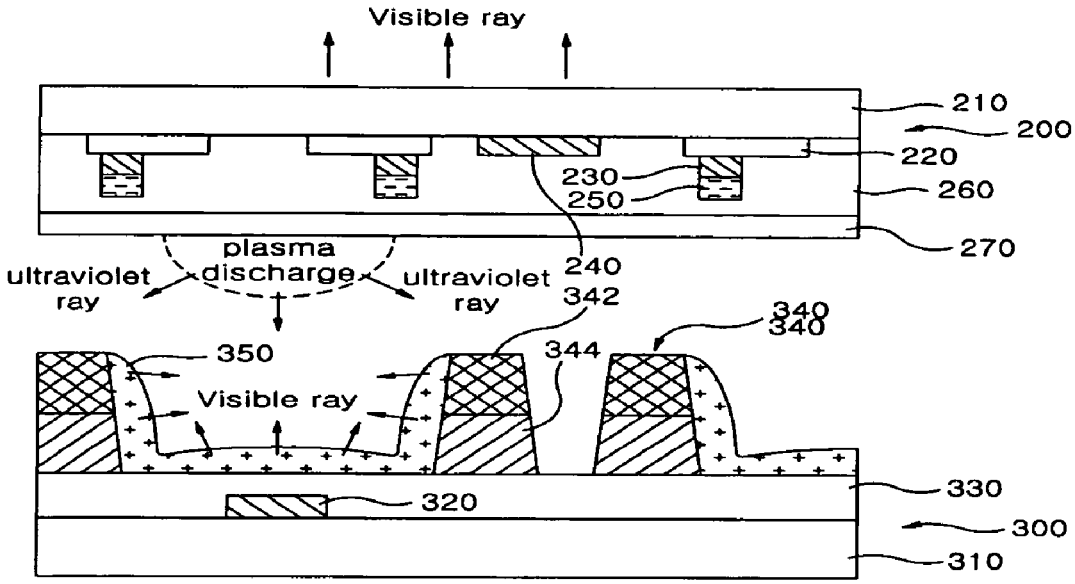
FIG. 1 is a cross-sectional view of a PDP according to an embodiment of the present invention.

Turning first to FIG. 1, which is a cross-sectional view of a PDP according to an embodiment of the present invention. As shown, the PDP includes an upper plate 200 and a lower plate 300. Further, the upper plate 200 includes transparent electrodes 220, bus electrodes 250, first and second black matrix 230 and 240, an upper dielectric layer 260, and a protection layer 270 formed on a lower side of a glass substrate 210 (hereinafter, referred to as the "upper substrate"). Also, the transparent electrodes 220 are made of a transparent conductive material such as indium tin oxide (ITO) or indium zinc oxide (IZO) to transmit the light generated from the discharge cells.

In addition, the bus electrodes 250 are present on the transparent electrodes 220 to reduce a line resistance of the transparent electrodes 220, and may be made of a silver (Ag) paste having a high conductivity. Thus, because the bus electrodes 250 are generally made of a material having a high electrical conductivity, the electrodes 250 reduce the driving voltage of the transparent electrodes 220 having a relatively low electrical conductivity.

Further, the first black matrix 230 is formed as a very thin layer between the transparent electrodes 220 and the bus electrodes 250 to allow an electric current to pass through between the transparent electrodes 220 and the bus electrodes 250 and to enhance the contrast of the PDP. In addition, the second black matrix 240 is disposed between discharge cells to absorb outside light and inside transmitting light between adjacent discharge cells and to also enhance the contrast of the PDP. The second black matrix 240 also serves to divide or compart the discharge cells.

Further, the upper dielectric layer 260 directly contacts the bus electrodes 250 and may be made of a PbO-based glass to avoid chemical reactions with the bus electrodes 250 made of a metallic material. Moreover, the upper dielectric layer 260 restricts a discharge current to maintain a glow discharge, and thus the electric charges generated at the time of plasma discharge are deposited on the upper dielectric layer 260. The protection layer 270 prevents the upper dielectric layer 260 from becoming damaged due to sputtering at the time of plasma discharge, and increases the discharge efficiency of the secondary electrons. Further, the protection layer 270 may be made of magnesium oxide (MgO).

As shown in FIG. 1, the lower plate 300 of the PDP includes a glass substrate 310 (hereinafter, referred to as the "lower substrate"), address electrodes 320, a lower dielectric layer 330, barrier ribs 340, and a phosphor layer 350 disposed on the upper surface of the lower substrate 310. In addition, the address electrodes 320 are positioned at about the center of each discharge cell, and may have a line width of about 70 to 80 μm.

Further, the lower dielectric layer 330 is disposed over the entire surface of the lower substrate 310 and the address electrodes 320, and protects the address electrodes 320. As shown, the barrier ribs 340 are positioned on top of the lower dielectric layer 330 spaced at a predetermined distance from the address electrodes 320, and are formed to be longer in the perpendicular direction.

Further, as shown in FIG. 1, the barrier ribs 340 have a double-layered structure including a lower barrier rib 344 and an upper barrier rib 342. The cross-sectional shape of the barrier ribs 340 may also be rectangular where the upper barrier rib 342 has the same width as the lower barrier rib 344. Alternatively, the cross-sectional shape of the barrier ribs 340 may be trapezoidal where the upper barrier rib 342 is narrower in width than the lower barrier rib 344.

In addition, the barrier ribs 340 are present to maintain the discharge space and prevent electrical and optical interference between adjacent discharge cells. Further, the phosphor layer 350 is formed on both sides of the barrier ribs 340 and the upper surface of the lower dielectric layer 330. The phosphor layer 350 is excited by the ultraviolet rays generated at the time of plasma discharge to generate red (R), green (G) or blue (B) visible rays.

Next, the light emitting mechanism of a PDP will be described. First, upon a predetermined voltage (within a voltage margin) between the transparent electrode 220 and the bus electrode 250, an additional voltage is applied to the address electrodes 320 that is sufficient to generate plasma between the transparent electrode 220 and the bus electrode 250. In addition, a certain amount of free electrons exists in the gas and a force ($F=q\cdot E$) is exerted to the free electrons when an electrical field is applied to the gas.

If the force-exerted electrons obtain energy (first ionization energy) sufficient to remove electrons in the outermost orbit, the electrons ionize the gas, and the ions and electrons created in the gas move to both electrodes by an electromagnetic force. Particularly, secondary electrons are generated when the ions collide with the protection layer 250, and the secondary electrons help create the plasma. Thus, a high voltage creates an initial discharge, but once a discharge is initiated, a lower voltage is used as the electron density increases.

In addition, the gas provided in the PDP cells is generally an inert gas such as Ne, Xe, He, etc. Particularly, when Xe is under a quasi stable state, an ultraviolet ray with a wavelength of between about 147 and 173 nm is generated and applied to the phosphor layer 350 to emit red, green or blue visible rays. Further, the color of visible rays emitted from each discharge cell is determined according to the type of phosphor lining the discharge cell, and thus each discharge cell becomes a sub-pixel representing a red, green or blue color.

In addition, the color of each discharge cell is controlled by a combination of light emitted from the three sub-pixels, and may be controlled at the time the plasma is generated. Further, the visible rays generated as described above are emitted to the outside of the cell through the upper substrate 210.

Figure 2A:
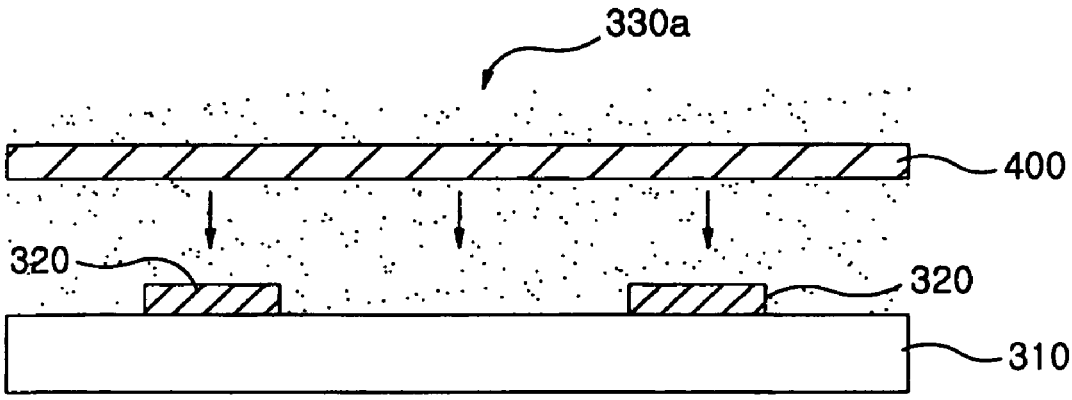
FIGS. 2*a* to 2*i* are sectional views illustrating a manufacturing process of a lower dielectric layer and a barrier rib of a lower substrate of the PDP in FIG. 1.

Hereinafter, the process of manufacturing the lower plate 300 and more particularly the lower dielectric layer 330 and the barrier rib 340 will be described with respect to FIGS. 2*a* to 2*i*. In FIG. 2*a*, the address electrodes 320 may be formed on the lower substrate 310 by sputtering, ionic plating, chemical deposition, electro deposition and the like, and then a mesh 400 is disposed over the lower substrate 310.

Figure 2B:
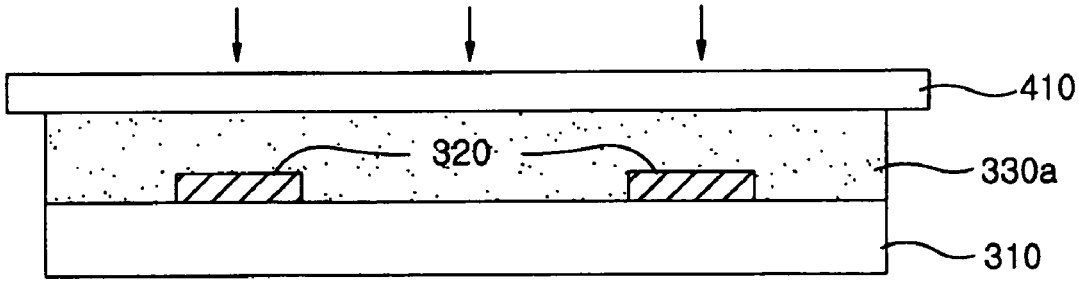
Figure 2C:
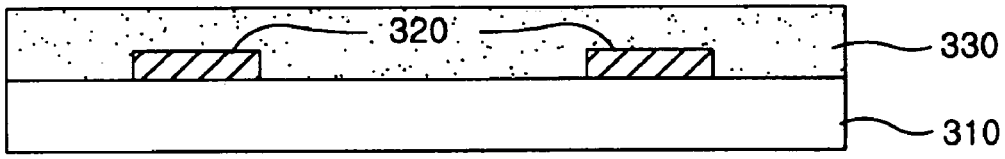

Subsequently, a lower dielectric layer-forming glass powder 330*a* is dispersed through the mesh 400. Here, only the lower dielectric layer-forming glass powder 330*a* from which a foreign element is removed is dispersed on the lower dielectric layer 330. Then, as shown in FIG. 2*b*, a press 410 applies a certain pressure and heat to the glass powder 330*a* to form the lower dielectric layer 330 as shown in FIG. 2*c*.

Figure 2D:
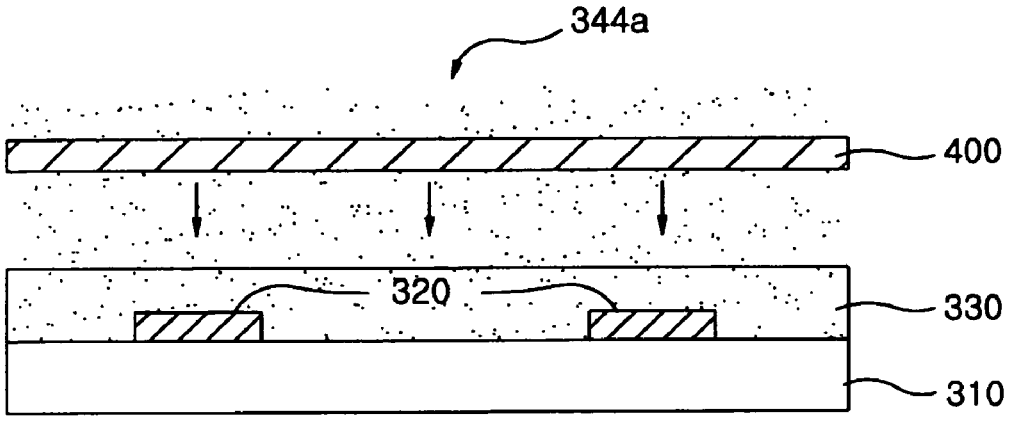

Then, as shown in FIG. 2*d*, the mesh 400 is disposed over the lower dielectric layer 330, and a first glass powder 344*a* is dispersed through an upper part of the mesh. The first glass powder 344*a* is made up of materials used to form the lower barrier rib 344. Similarly, only the first glass powder 344*a* from which foreign element is removed is dispersed on the lower dielectric layer 330.

Figure 2E:
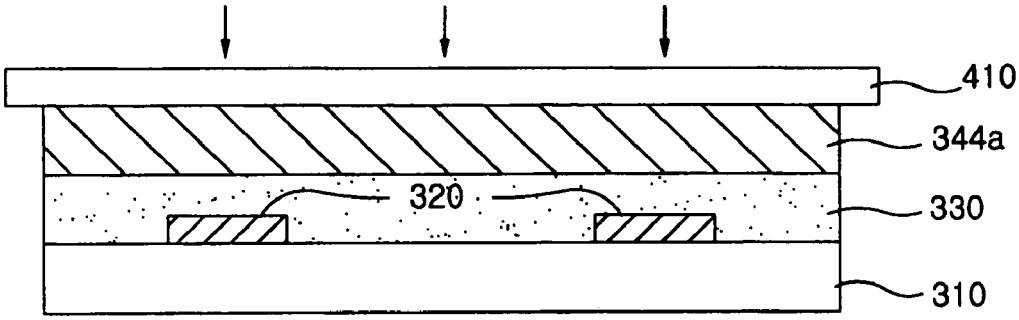
Figure 2F:
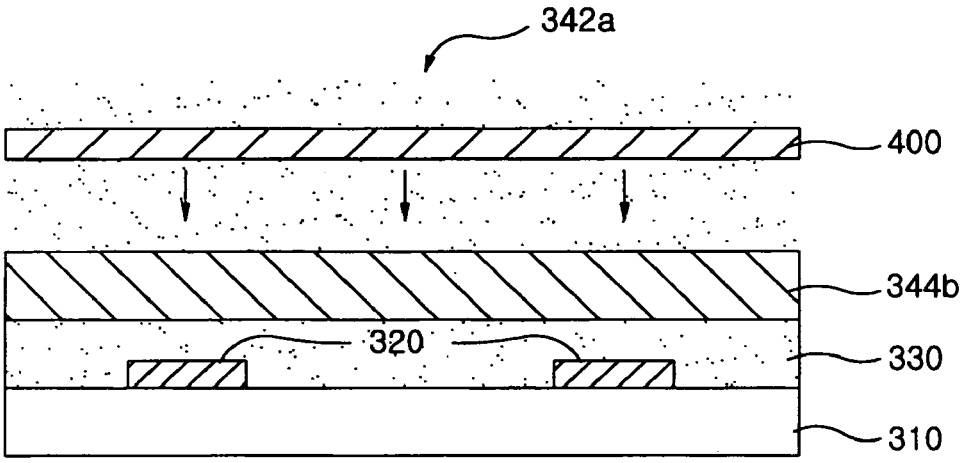

Subsequently, as shown in FIG. 2*e*, the press 410 applies a certain pressure and heat to the first glass powder 344*a*, thereby forming the lower barrier rib-forming layer 344*b*. Next, as shown in FIG. 2*f*, the mesh 400 is disposed over the lower barrier rib-forming layer 344*b*, and a second glass powder 342*a* is dispersed through the mesh 400. The second glass powder 342*a* is made up of materials to form the upper barrier rib 342*b*, and only the second glass powder 342*a* from which foreign element is removed is dispersed on the lower barrier rib-forming layer 344*b*.

Figure 2G:
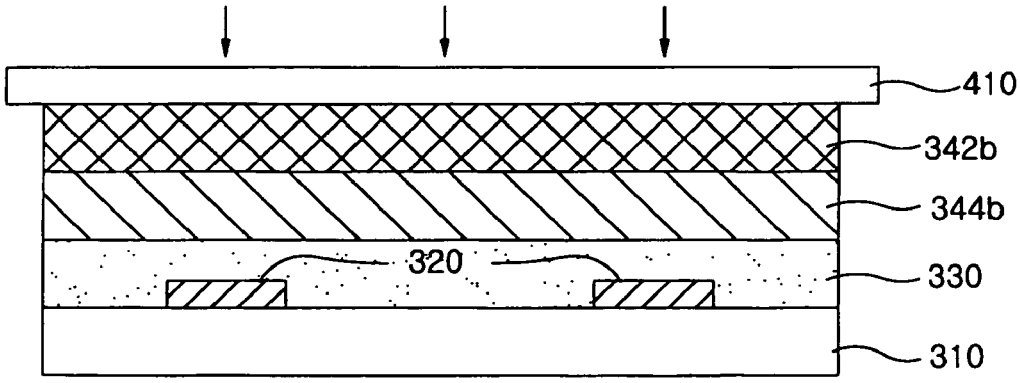
Figure 2H:
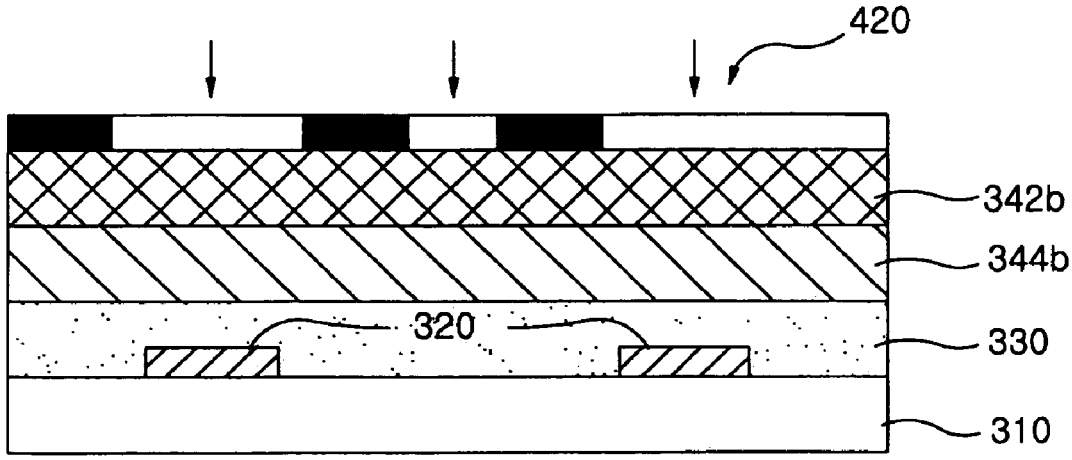

Subsequently, as shown in FIG. 2*g*, the press 410 applies a certain amount of pressure and heat to the second glass powder 342*a*, thereby forming the upper barrier rib-forming layer 342*b*. Then, as shown in FIG. 2*h*, a mask 420 with openings therein is disposed on the lower substrate 310 including the lower barrier rib-forming layer 344*b* and the upper barrier rib-forming layer 342*b*. The mask 420 has openings in areas other than those corresponding to where the barrier ribs 340 are to be formed.

Further, the lower substrate 310 on which the mask 420 is disposed is treated with an etching agent to etch the lower barrier rib-forming layer 344*b* and the upper barrier rib-forming layer 342*b* in the areas corresponding to the openings of the mask 420, thereby shaping the barrier ribs 340 to include an upper barrier rib portion 342 and a lower barrier rib portion 344.

Figure 2I:
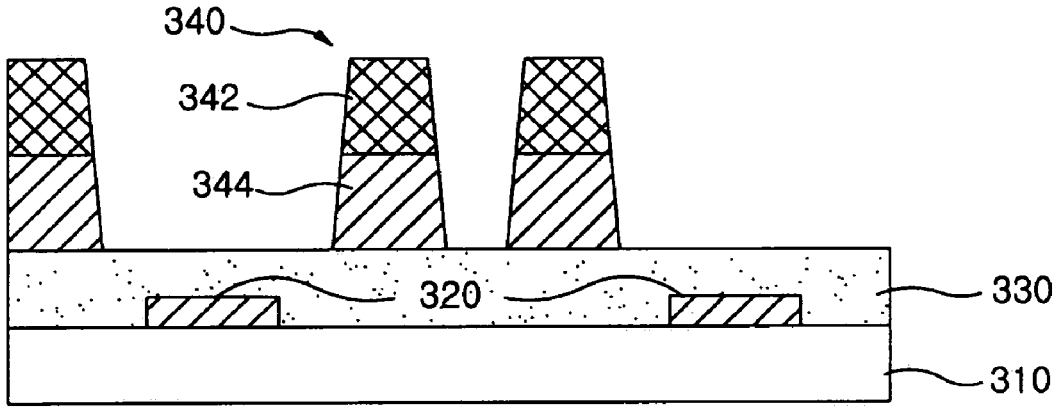

In addition, in the etching process, the lower barrier rib-forming layer 344*b* has a higher etching rate than the upper barrier rib-forming layer 342*b*. Thus, under such a condition, the upper barrier rib-forming layer 342*b* is less damaged by side etching while the lower barrier rib-forming layer 344*b* is being etched. Accordingly, as shown in FIG. 2*i*, a rectangular or trapezoid cross-sectional shape of the barrier ribs 340 that are structurally and mechanically stable is obtained. In addition, once the barrier ribs 340 are formed, a sintering process, for example, is performed.

As described above, in the method of manufacturing the lower substrate of the PDP, a paste composition or green sheet is not used. Rather, the lower dielectric layer 330 and the barrier rib 340 are formed using a glass powder such as a PbO-based glass powder, ZnO-based glass power or a mixture thereof. Preferably, the glass powder is a $PbO—B_2O_3—SiO_2$-based glass powder, $PbO—B_2O_3—SiO_2—Al_2O_3$-based glass powder, $ZnO—B_2O_3—SiO_2$-based glass powder, $PbO—ZnO—B_2O_3—SiO_2$-based glass powder, $B_2O_3—SiO_2$-based glass powder or the mixture thereof. Subsequently, a phosphoric material is dispersed inside the cells defined by the barrier ribs 340 to form the phosphor layer 350. In addition, the lower dielectric layer 330 or the barrier rib 340 may also be formed by using the glass powder.

Thus, because the barrier ribs 340 and the lower dielectric layer 330 are formed by using a glass powder, the process of manufacturing a lower substrate is simple, and the manufacturing cost is less expensive. The barrier ribs also have a sufficiently structurally and mechanically stable shape to retain a discharging space, because the etching rates between the upper and lower parts of barrier rib are different from each other to prevent damage of barrier ribs by side-etching.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A method of manufacturing a plasma display panel, comprising:

forming a lower dielectric layer on a lower substrate;

forming a barrier rib-forming layer on the lower dielectric layer; and forming barrier ribs by patterning the barrier rib-forming layer, wherein forming the barrier rib-forming layer comprises:

disposing a mesh over the lower substrate on which the lower dielectric layer is formed;

dispersing a material for the barrier ribs through the mesh; and applying a certain amount of heat and pressure to the dispersed material for the barrier ribs, wherein the material for the barrier ribs is a glass powder.

2. The method of claim 1, wherein forming the barrier ribs further comprises sintering the barrier ribs.

3. The method of claim 1, wherein the barrier rib-forming layer comprises:

a lower barrier rib-forming layer formed of a first glass powder; and an upper barrier rib-forming layer formed of a second glass powder.

4. The method of claim 3, wherein the lower barrier rib-forming layer is formed by disposing the mesh over the lower substrate on which the lower dielectric layer is formed;

dispersing the first glass powder through the mesh; and applying a certain amount of heat and pressure to the dispersed first glass powder.

5. The method of claim 3, wherein the upper barrier rib-forming layer is formed by disposing the mesh over the lower barrier rib-forming layer;

dispersing the second glass powder through the mesh; and applying a certain amount of heat and pressure to the dispersed second glass powder.

6. The method of claim 3, wherein an etching rate of the lower barrier rib-forming layer is higher than an etching rate of the upper barrier rib-forming layer.

7. The method of claim 1, wherein patterning the barrier rib-forming layer comprises:

disposing a mask having openings on a surface of the barrier rib-forming layer, wherein the openings expose portions of the barrier rib-forming layer; and etching the exposed portion through the openings of the mask.

8. The method of claim 1, wherein forming the lower dielectric layer comprises:

disposing the mesh over the substrate on which address electrodes are formed;

dispersing another glass powder for the dielectric layer through the mesh; and applying a certain amount of heat and pressure to the dispersed glass powder to form the dielectric layer.

9. The method of claim 1, wherein the glass powder is a $PbO—B_2O_3—SiO_2$-based glass powder, $PbO—B_2O_3—SiO_2—Al_2O_3$-based glass powder, $ZnO—B_2O_3—SiO_2$-based glass powder, $PbO—ZnO—B_2O_3—SiO_2$-based glass powder, $B_2O_3—SiO_2$-based glass powder or a mixture thereof.

10. The method of claim 1, further comprising:

forming a plurality of address electrodes on the lower substrate;

forming a phosphor layer on the lower dielectric layer between the barrier ribs;

forming transparent and bus electrodes on an upper substrate;

forming an upper dielectric layer on the upper substrate;

forming a protection layer over the upper dielectric layer; and disposing the upper substrate above the lower substrate to form the plasma display panel.

* * * * *